US010729299B2

(12) United States Patent
Barabeisch et al.

(10) Patent No.: US 10,729,299 B2
(45) Date of Patent: Aug. 4, 2020

(54) SUCTION DEVICE

(71) Applicant: Festool GmbH, Wendlingen (DE)

(72) Inventors: Markus Barabeisch, Vohringen (DE); Steffen Dirr, Vohringen (DE)

(73) Assignee: Festool GmbH, Wendlingen (DE)

( * ) Notice: Subject to any disclaimer, the term of this patent is extended or adjusted under 35 U.S.C. 154(b) by 191 days.

(21) Appl. No.: 16/070,387

(22) PCT Filed: Jan. 11, 2017

(86) PCT No.: PCT/EP2017/050491
§ 371 (c)(1),
(2) Date: Jul. 16, 2018

(87) PCT Pub. No.: WO2017/125298
PCT Pub. Date: Jul. 27, 2017

(65) Prior Publication Data

US 2019/0014963 A1 Jan. 17, 2019

(30) Foreign Application Priority Data

Jan. 19, 2016 (DE) ..... 10 2016 100 780

(51) Int. Cl.
*A47L 9/20* (2006.01)
*A47L 9/14* (2006.01)
*A47L 9/16* (2006.01)

(52) U.S. Cl.
CPC ..... *A47L 9/20* (2013.01); *A47L 9/1454* (2013.01); *A47L 9/1683* (2013.01)

(58) Field of Classification Search
CPC ..... A47L 9/1454; A47L 9/1683; A47L 9/20
(Continued)

(56) References Cited

U.S. PATENT DOCUMENTS 1,259,008 A 3/1918 Fraser
8,474,093 B2 * 7/2013 Treitz ..... A47L 9/20 15/352

(Continued)

FOREIGN PATENT DOCUMENTS

CN 1378814 A 11/2002
DE 1800480 A 6/1970

(Continued)

OTHER PUBLICATIONS

German Search Report for corresponding German Patent Application No. 10 2016 100 780.3, pp. 1-11 (dated Oct. 11, 2016).

(Continued)

*Primary Examiner* — Marc Carlson
(74) *Attorney, Agent, or Firm* — Hoffmann & Baron, LLP

(57) ABSTRACT

A suction device, having a suction unit for generating a suction flow and having a suction-device housing, in which a dirt-collecting chamber is arranged, which has a suction inlet and is flow-connected to the suction unit via at least one filter and a suction-extraction channel arrangement, wherein at least one external-air inlet, which can be closed by an external-air valve, is arranged on the suction-extraction channel arrangement between the filter and the suction unit, wherein the external-air valve has an external-air-valve body for closing the external-air inlet, which external-air-valve body can be moved, by movement of an actuating element along an actuation path. A transmission is arranged between the actuating element and the external-air-valve body, which transmission enables movement of the actuating element.

18 Claims, 5 Drawing Sheets

(58) Field of Classification Search
USPC ..... 15/352
See application file for complete search history.

(56) References Cited

U.S. PATENT DOCUMENTS

| | | | | |
|---|---|---|---|---|
| 8,961,633 | B2 * | 2/2015 | Kienzle | A47L 9/20 15/345 |
| 2016/0150932 | A1 * | 6/2016 | Foenss | A47L 5/365 134/21 |

FOREIGN PATENT DOCUMENTS

| | | | | |
|---|---|---|---|---|
| DE | 1800480 | A1 * | 6/1970 | A47L 9/0072 |
| DE | 29715048 | U1 | 11/1997 | |
| DE | 10101219 | B4 | 7/2004 | |
| DE | 10101218 | B4 | 8/2005 | |
| DE | 10148180 | B4 | 4/2006 | |
| DE | 102010004706 | A1 | 9/2010 | |
| DE | 102010029524 | A1 * | 12/2011 | A47L 9/20 |
| DE | 102010026486 | A1 | 1/2012 | |
| DE | 102005035884 | B9 | 6/2012 | |
| DE | 102012009976 | A1 | 11/2013 | |
| DE | 102013007183 | | 10/2014 | |
| EP | 0955003 | B1 | 2/1999 | |
| EP | 0955003 | A1 * | 11/1999 | F16K 17/0453 |
| EP | 1148805 | B1 | 12/1999 | |
| EP | 1166705 | A1 | 6/2001 | |
| EP | 1340446 | A1 * | 9/2003 | B01D 46/10 |
| EP | 1868478 | B1 | 1/2006 | |
| EP | 1868479 | B1 | 1/2006 | |
| EP | 2046182 | B1 | 7/2006 | |
| EP | 2046183 | B1 | 7/2006 | |
| EP | 2046184 | B1 | 7/2006 | |
| EP | 2049001 | B1 | 7/2006 | |
| EP | 2002773 | B1 | 6/2008 | |
| EP | 2052660 | B1 | 10/2008 | |
| EP | 2421630 | B1 | 4/2009 | |
| EP | 2255708 | B1 | 5/2009 | |
| EP | 2575585 | B1 | 5/2010 | |
| EP | 2672870 | B1 | 2/2011 | |
| EP | 2575586 | B1 | 5/2011 | |
| EP | 2601876 | A1 | 7/2011 | |
| EP | 2734098 | B1 | 7/2011 | |
| EP | 2662011 | A1 | 5/2012 | |
| EP | 2880221 | B1 | 8/2012 | |
| EP | 2606796 | A2 | 11/2012 | |
| EP | 2630902 | A1 | 2/2013 | |
| EP | 2644072 | A2 | 3/2013 | |
| EP | 2644073 | A1 | 3/2013 | |
| EP | 2644076 | A1 | 3/2013 | |
| EP | 2835089 | A3 | 8/2014 | |
| WO | WO9719630 | | 6/1997 | |
| WO | WO-9719630 | A1 * | 6/1997 | A47L 9/20 |
| WO | WO0040136 | A1 | 7/2000 | |
| WO | WO2006108459 | A1 | 10/2006 | |
| WO | WO2006108460 | A1 | 10/2006 | |
| WO | WO2008014794 | A1 | 2/2008 | |
| WO | WO2008014795 | A1 | 2/2008 | |
| WO | WO2008014797 | A1 | 2/2008 | |
| WO | WO2008014798 | A1 | 2/2008 | |
| WO | WO2008043440 | A1 | 4/2008 | |
| WO | WO2008091203 | A1 | 7/2008 | |
| WO | WO2010028787 | | 3/2010 | |
| WO | WO2010028787 | A1 | 3/2010 | |
| WO | WO2010121656 | A1 | 10/2010 | |
| WO | WO2010124912 | A1 | 11/2010 | |
| WO | WO2011003441 | | 1/2011 | |
| WO | WO2011003441 | A1 | 1/2011 | |
| WO | WO2011150957 | A1 | 12/2011 | |
| WO | WO2011151217 | A1 | 12/2011 | |
| WO | WO2011151219 | A1 | 12/2011 | |
| WO | WO2012034635 | A1 | 3/2012 | |
| WO | WO2012107103 | A1 | 8/2012 | |
| WO | WO2012107595 | A1 | 8/2012 | |
| WO | WO2012130806 | A1 | 10/2012 | |
| WO | WO-2012130806 | A1 * | 10/2012 | A47L 5/365 |
| WO | WO2012145587 | A1 | 10/2012 | |
| WO | WO2013013696 | A1 | 1/2013 | |
| WO | WO2013168071 | A1 | 11/2013 | |
| WO | WO2014019620 | A1 | 2/2014 | |
| WO | WO2014173481 | A1 | 10/2014 | |
| WO | WO-2017025305 | A1 * | 2/2017 | A47L 9/20 |

OTHER PUBLICATIONS

English Abstracts for EP 2 644 073 A1, EP 2 644 076 A1, DE 10 2005 035 884 B9, EP 1 166 705 A1, DE 101 01 218 B4, DE 101 01 219 B4, DE 297 15 048 U1, DE 10 2012 009 976 A1, DE 10 2010 026 486 A1, DE 10 2010 004 706 A1, DE 101 48 180 B4 and EP 2 835 089 A3. (2 pages).

* cited by examiner

SUCTION DEVICE

This application claims priority based on an International Application filed under the Patent Cooperation Treaty, PCT/EP2017/050491, filed Jan. 11, 2017, which claims priority to DE102016100780.3, filed Jan. 19, 2016.

BACKGROUND OF THE INVENTION

The invention relates to a suction device having a suction unit for generating a suction flow and having a suction device housing, in which a dirt collecting chamber is arranged, which has a suction inlet and is flow-connected to the suction unit via at least one filter and an extraction channel arrangement, wherein at least one external air inlet, which can be closed by an external air valve, is arranged on the extraction channel arrangement between the filter and the suction unit, wherein the external air valve has an external air valve body for closing the external air inlet, which external air valve body can be moved, by adjusting an actuating element along an actuation path, between a closed position closing the external air inlet and a passage position releasing the external air inlet, in which external air flowing through the external air inlet flows through the at least one filter in the direction of the dirt collecting chamber for cleaning purposes.

A suction device of this type is described in EP 1 340 446 A1, for example. In this suction device, a so-called counterflow cleaning process is performed. Negative pressure provided by the suction unit is instantaneously applied to the external air valve body to move it into the passage position, so that external air can enter through the external air inlet and flow through the filter in the direction of the dirt collecting chamber, so that particles adhering to the filter are ejected in the direction of the dirt collecting chamber. The closing body is designed as a flap to which a relatively great force provided by an electromagnet has to be applied in the direction of the closed position. The construction is complex and expensive.

WO 2011/003441 A1 discloses a suction device with an external air inlet closed by a valve body which can be actuated from a closed position into an open position by an energy storage device. The energy storage device is supplied with energy for storage by the actuation of an actuating element.

A manual actuation of an external air valve requires force and has to be very fast in order to facilitate an optimum cleaning of the filter by a flow reversal which is as instantaneous as possible. This is difficult in practical applications.

SUMMARY OF THE INVENTION

The present invention is therefore based on the problem of providing a suction device with an improved cleaning concept.

To solve this problem, it is provided in a suction device of the type referred to above that a transmission is arranged between the actuating element and the external air valve body, which transmission enables a movement of the actuating element over at least one free travel segment of the actuating path without any effect on the external air valve body and, on an actuating segment of the actuating path of the actuating element, releases the external air valve body for movement from the closed position to the passage position and/or transmits an actuating force of the actuating element acting towards the passage position to the external air valve body.

It is a fundamental idea of the present invention that the actuating element is not permanently or directly connected to the external air valve body, but rather via a transmission. Being a mechanical transmission, the transmission has a kind of free travel over at least a part or a sub-segment of the actuating path, so that while an operator or drive motor actuates the actuating element, there is no effect on the external air valve body along the free travel segment. The at least one free travel segment can be used for further mechanical functions, e.g. for tensioning one or more springs which may be used to return the external air valve body into the closed position and/or the actuating element into the starting position. Another possibility is a configuration in which an opening spring is preloaded or charged, in a manner of speaking, for opening the at least one external air valve body and then released, preferably instantaneously, to move the external air valve body into the passage position. In this process, it is possible for the external air valve body to be moved actively towards the passage position by means of the actuating element, being subjected to a suitable pressure or thrust force, for example. It is, however, also possible that the external air valve body is loaded towards the passage position by other means, such as spring force and/or negative pressure, and released on the actuating segment in the direction of the passage position.

The external air valve body can be designed in several parts, comprising several closing bodies, for example, which are correspondingly assigned to several external air inlets. It is furthermore possible that several separate external air valve bodies can be actuated or driven by a single actuating element. The wording "external air valve body" can therefore also denote "at least one external air valve body", but this version is not realised in the claims and in the subsequent description for the sake of simplicity and easier understanding.

The actuating path of the actuating element extends, for example, from a starting position assigned to the closed position of the external air valve body to an end position which is farthest away from the starting position. Between these positions, the actuating segment may be located. It is also possible for the actuating segment to be close to the end position. The actuating element may, for example, pass through the actuating path in an oscillating or reciprocating manner. However, a circular actuating path or a rotary movement of the actuating element is also conceivable for acting on the transmission, with a corresponding free travel segment being assigned to this rotary movement as well.

The at least one free travel segment may comprise one or more free travel segments. It is, for example, possible that the at least one free travel segment of the actuating path comprises a free travel segment which extends between a starting position assigned to the closed position of the external air valve body and the actuating segment. On this free travel segment, a spring accumulator or another energy storage device can, for example, be therefore already be charged by the actuating element either directly or via the transmission. It is also possible that the actuating element is accelerated or gains momentum on this as it were first free travel segment, so that the external air valve body can be actuated on the adjoining actuating segment towards the passage position with a correspondingly great force or high speed. The actuating element expediently has an inertia mass body.

As an alternative or in addition to the free travel segment explained above, a free travel segment may be provided which extends between the actuating segment and an end position of the actuating element, which is not assigned to the passage position of the external air valve body or farthest away from the starting position of the actuating element.

It is advantageous if the actuating element and/or the transmission form(s) or comprise(s) an actuating device for moving the external air valve body in the direction of its closed position.

When moving along the actuating path, the actuating element or the transmission can therefore be used advantageously on the one hand for releasing or actively actuating the external air valve body in the direction of its passage position and on the other hand for actuating or driving the external air valve body in the direction of its closed position.

It is preferably provided that the suction device comprises an energy storage device for moving the external air valve body into the passage position or the closed position. The energy storage device serves to provide an actuating force actuating the external air valve body towards the passage position or the closed position. The energy storage device may, for example, comprise at least one spring or a spring assembly. The spring or spring assembly, for example, comprises one or more coil springs, a rubber-elastic buffer or the like. The energy storage device may, however, also comprise at least one fluidic storage device such as an accumulator. A pneumatic spring can, for example, be charged as an energy storage device. The energy storage device may furthermore be a device for storing electric energy, which can preferably be instantaneously discharged, e.g. a capacitor.

The energy storage device may at the same time form an actuating device for moving the external air valve body into the passage position or the closed position, or the actuating device may be represented by the energy storage device. A spring which directly loads the external air valve body in the direction of the closed position is, for example, both such an actuating device and a corresponding energy storage device.

It is expedient if the energy storage device can be charged at an actuation of the actuating element along the at least one free travel segment. The energy storage device can expediently be charged at an actuation of the actuating element along at least two free travel segments or along each free travel segment. The free travel of the actuating element can therefore be used advantageously for charging the energy storage device, e.g. tensioning a spring. The at least one free travel segment is therefore particularly useful because it facilitates a charging of the energy storage device without the external air valve body being released or being capable of actuation in the direction of the passage position. The energy storage device or the spring assembly can furthermore easily be charged or tensioned during a movement of the actuating element along the actuating segment. It is preferred if the energy storage device is charged or tensioned during the whole or substantially the whole of the actuating path of the actuating element.

It is advantageous if the energy storage device is coupled to the actuating element and/or the transmission and/or the external air valve body as a respective actuating component, so that the energy storage device is charged at a movement of the actuating component, i.e. of the actuating element, the transmission or the external air valve body. If the external air valve body is moved from the closed position into the passage position, for example, it can charge or tension the energy storage device, e.g. a return spring. It is also possible for the transmission to act on the energy storage device, thereby charging it. It is obviously possible that an energy storage device can be actuated by two actuating components, e.g. the transmission and the actuating element. As the drawing shows, it is preferred if the energy storage device is charged or tensioned by the actuating element while it is moved along its actuating path.

It is expediently provided that the actuating element is loaded towards the starting position by a return spring.

It is preferred if the actuating element charges or tensions the energy storage device during its movement along its actuating path. The actuating element is preferably loaded by the energy storage device, e.g. a spring assembly or the spring assembly, towards the starting position of the actuating path, which is in turn assigned to the closed position of the valve body. If the actuating element is moved along the at least one free travel segment, it tensions the spring assembly or charges the energy storage device.

It is advantageous if the energy storage device acts on the external air valve body for movement into the passage position or the closed position via a power-boosting gear mechanism, e.g. the transmission. The power-boosting gear mechanism may also comprise the actuating element. It is preferred if the power-boosting gear mechanism comprises a bevel or lever gear mechanism or the like. The power-boosting gear mechanism can, for example, be located on the actuating element, e.g. in the manner of a bevel or wedge mechanism. The power-boosting gear mechanism can, however, also to be at least partially represented by the actuating element, for example if the latter is designed as a lever by means of which the external air valve body can be moved into the closed position.

The actuating element may comprise an actuating lever or an actuating slide, for example.

It is preferred if the actuating element can be actuated manually. It is, however, also possible that the actuating element can be driven by an actuator or servomotor which is a part of the suction device. In this case, too, it is advantageous if the actuating element has a certain degree of free travel without affecting the external air valve body, this free travel being used for charging the energy storage device described above, for example.

A combination of motor drive and manual control of the actuating element can easily be implemented as well. At a failure of the servomotor, for example, the actuating element can be actuated manually in a kind of emergency mode. For this purpose, it is, for example, possible that the servomotor is coupled to the actuating element via a free travel mechanism, so that it can be actuated manually if required, free of resistances of the servomotor or with low resistance by the servomotor. It is also possible for a servomotor to boost a manual force acting on of the actuating element.

The actuating element or in any case a manual actuating range or segment of the actuating element is preferably located on an upper part or a top side of the suction device housing. In the use of the suction device, the upper part or top side of the suction device housing is easily accessible.

In a manual operating concept, in particular, it is advantageous if the operator applies a force in the direction of the suction device housing, in particular in the direction of a ground. It is, for example, expedient if the actuating element has a manually actuable actuating range or segment, wherein the transmission segment passes through a movement path in the direction of the suction device housing and/or of a ground on which the suction device is placed for moving the external air valve body in the direction of the passage position. The direction of the actuating force or the actuating path is therefore not tangential to the suction device housing but in the direction of the suction device housing. As a result, the suction device housing, in a manner of speaking, provides a resistance or forms an abutment. This abutment may, however, also be represented by the ground on which the suction device is placed in use. The above-described movement path of the actuating segment is preferably oriented such that, for moving the external air valve body in the direction of the passage position, it extends towards a base side of the suction device housing, which is oriented towards a ground or assigned to the ground. If, for example, the actuating element is arranged at an upper part or a top side of the suction device housing, which is advantageous, the operator can apply a downward force or pressure to the actuating element in the direction of the lower part of the suction device housing or of the ground, which is very ergonomic.

It is also advantageous if a force direction or actuating direction for the manual actuation of the actuating element when using the suction device is oriented approximately vertically. A transmission segment of the actuating element could, for example, project upwards in front of the suction device and is pushed downwards by the operator towards the suction device housing. The transmission segment may, however, also project laterally from the suction device housing and be pushed down by the operator.

The actuating element is expediently mounted slidably relative to the suction device housing, for example by means of a sliding bearing, and/or pivotably, for example by means of a pivot bearing. In the sliding bearing, linear displaceability is advantageous. In the pivot bearing, a mounting of the actuating element in the manner of a swivelling lever is expedient. The actuating element may comprise a slide or a suitable swivelling lever or swivelling arm, for example. A pivot-and-slide mounting is, however, easily possible as well, i.e. an arrangement in which the actuating element is movably mounted with several degrees of freedom for movement along the actuating path.

It is advantageously provided that the transmission is designed for an instantaneous release of the external air valve body or an instantaneous transmission of the actuating force of the actuating element to the external air valve body in the direction of the passage position. This facilitates an advantageous operating mode in which the external air inlet is opened up instantaneously.

A relatively long actuating path with a relatively short actuating segment is advantageous. It is expediently provided that the at least one free travel segment is at least twice as long, preferably at least three times as long, as the actuating segment. In this way, the energy storage device can, for example, be charged or tensioned along a relative long path of the actuating element, so that it makes available correspondingly high forces for moving the external air valve body. In this constellation, the energy storage device is particularly suitable for returning the external air valve body instantaneously or very fast in the direction of the closed position, so that the cleaning operation acquires a pulsed quality, facilitating an optimum cleaning of the filter.

It is expediently also provided that the actuating path of the actuating element is considerably longer than a closing path of the external air valve body between the passage position and the closed position. The actuating path of the actuating element is, for example, at least 1.5 times, preferably twice or three times, as long as the closing path of the external air valve body.

It is preferred if the transmission has a pawl and/or step and/or bevel and/or actuating slide assigned to the actuating segment. The pawl or step can be arranged on the external air valve body, for example, and released instantaneously by the transmission, e.g. the actuating slide, when the actuating segment is passed through.

A step can be arranged directly on the actuating element, for example. The external air valve body can, for example, still be held in the closed position by the transmission or actuating element along an actuating segment in front of the step, but then be released at the step, thereby instantaneously reaching the passage position. It is possible that a bevel is also arranged on such a step, for example for decelerating the external air valve body before it reaches the passage position.

The transmission may comprise a bevel mechanism, for example. It is furthermore possible for the transmission to comprise a lever gear mechanism. As a lever, the transmission may, for example, comprise the actuating element, or the actuating element can act on a lever. The above lever is expediently used to move the external air valve body in the direction of the closed position or the passage position. On the actuating element, a bevel can be provided, for example, where a driving segment of the external air valve body moves along, so that the external air valve body is carried along towards the closed position as the actuating element moves in the direction of its starting position.

It is advantageous if the transmission is designed to boost the power of an energy storage device, e.g. a spring assembly or a return spring, which loads the external air valve body in the direction of its closed position. The spring assembly may, for example, act on the actuating element, actuating it in the direction of its starting position, with the transmission further boosting the return force of this spring assembly, for example via a bevel and/or a lever, which may be represented by the actuating element. The transmission acts on the external air valve body in the direction of its closed position. It is furthermore possible that the energy storage device, e.g. the spring assembly, actuates the actuating element in the direction of the starting position while simultaneously moving the external air valve body in the direction of its closed position via a bevel mechanism which is preferably located directly on the actuating body.

A bevel arrangement of the transmission for moving the external air valve body, in particular in the direction of its closed position, expediently comprises a first bevel and a second bevel with different inclinations. As a result, the bevels have different power boosting actions. This measure is in particular advantageous in the context of the energy storage device described above or of a return spring. A first bevel may, for example, be steeper than an adjoining second bevel, so that the second bevel boosts the return or actuating force of the energy storage device more than the first bevel. The first bevel in turn can cause a very fast or rapid movement. It is, for example, possible that the energy storage device initially moves the external air valve body in the direction of its closed position very fast via the first, steeper bevel, while the second bevel then provides a higher power boost at the end of the actuating path for closing the external air inlet.

It is possible that at least one bevel and at least one step are located directly on the actuating element.

An advantageous variant provides that the at least one bevel for moving the external air valve body into its closed position and a release contour, in particular a step, are motion-coupled or arranged one behind the other relative to the actuating path of the actuating element in such a way that first the at least one bevel for moving the external air valve body into its closed position and then the release contour act on the external air valve body or become active in respect thereto.

A driving region of the external air valve body is expediently accommodated slidably in a receptacle of the actuating element. The actuating element can be moved relative to the external air valve body along a sliding path of the receptacle. It is, for example, possible that the external air valve body remains in its closed position while the actuating element is already being actuated in the direction of its end position assigned to the open or passage position of the external air valve body. The receptacle at the actuating element moves relative to the external air valve body, which in its turn remains stationary and closes the external air opening. As soon as the external air valve body is released, it opens the external air inlet, adopting its passage position. In this process, the driving region of the external air valve body moves to an end region of the receptacle of the actuating element. If the actuating element is then moved back into the starting position, it drives the external air valve body in the direction of the closed position by providing that an abutment segment of the external air valve body stops at or rests against the actuating element.

An advantageous measure provides that the transmission comprises an actuating part which is designed as an actuating slide in particular and remains stationary on the at least one free travel segment relative to the external air valve body if not being actuated by the actuating element, and which is driven by the actuating element on the actuating segment in order to move the external air valve body into the passage position. The actuating part is expediently loaded by a spring assembly towards the position holding the external air valve body in the closed position. The actuating part can be a pivotably mounted component. Preferably, however, it is mounted slidably as shown in the drawing. The actuating part may be an actuating slide, for example, relative to which the actuating element can be displaced or pivoted for movement relative to the actuating part via the at least one free travel segment. When the end of the free travel segment is reached, however, i.e. the actuating segment is reached, the actuating element drives the actuating part by means of a driver, so that the actuating part in turn actively acts on the external air valve body in the direction of the passage position or, as shown in the drawing, releases the external air valve body for movement in the direction of the passage position.

It is preferred if the external air valve body is loaded towards its passage position by applying a negative pressure to the suction unit. It is expedient if a side facing the negative pressure region of the suction unit or the dirt collecting chamber, in particular an underside, of the external air valve body, is provided for moving the external air valve body in the direction of the passage position. The power of the suction unit or the negative pressure which is in particular present in the dirt collecting chamber before the cleaning process is relatively high and is therefore particularly suitable for moving the external air valve body and thus for opening the external air inlet. This measure contributes advantageously to a fast, instantaneous cleaning of the filter.

As an alternative or in addition to an application of negative pressure to the external air valve body in the direction of the passage position, it is, however, also possible that the external air valve body is acted on or driven in the direction of the passage position by an opening spring assembly and/or an opening power drive. The suction unit expediently has an opening spring assembly and/or an opening power drive, for example an electromagnet or an arrangement of electromagnetic drives, for actuating or driving the external air valve body in the direction of the passage position. The opening spring assembly comprises an opening spring, for example, in particular a coil spring. The opening spring is expediently supported at one end on a component permanently joined to or provided by the suction device housing and at the other end on the external air valve body.

It is, for example, expediently provided that the suction device comprises a closing spring assembly and/or a closing power drive, in particular a spring drive, for actuating or driving the external air valve body in the direction of the closed position.

The closing spring, for example, applies pressure to the external air valve body in the direction of the closed position. The closing spring is, for example, supported on the external air valve body and on a component joined to the suction device housing or directly on the suction device housing.

The external air inlet is preferably located at a wall of the suction device housing, e.g. at a cover of the suction device housing, adjacent to the actuating chamber housing. The external air inlet may, for example, be located between a top side of a cover of the suction device housing or a wall side of the suction device housing.

It is advantageous if an actuating assembly comprising the actuating element is located above the external air inlet. In this design, in particular, but also with a support laterally adjacent to the external air inlet, the external air valve body can be advantageously suspended from or supported on the actuating assembly.

An advantageous variant provides that a linear actuation axis of the actuating element and an actuation axis of the valve body extend at an angle, for example orthogonally, to each other between the closed position and the passage position.

The suction device is preferably a portable suction device, in particular a domestic vacuum cleaner or a workshop vacuum cleaner. Rollers are preferably arranged on the suction device housing. The suction device can have a carrying handle.

A filter bag or a receptacle can be provided in the dirt collecting chamber. The suction device may have a holder for a filter bag or a receptacle.

BRIEF DESCRIPTION OF THE DRAWINGS

Embodiments of the invention are explained below with reference to the drawing, of which:

FIG. 7 shows the external air valve according to FIGS. 5, 6 on actuation in the direction of a passage position shown in

DETAILED DESCRIPTION

Figure 1:
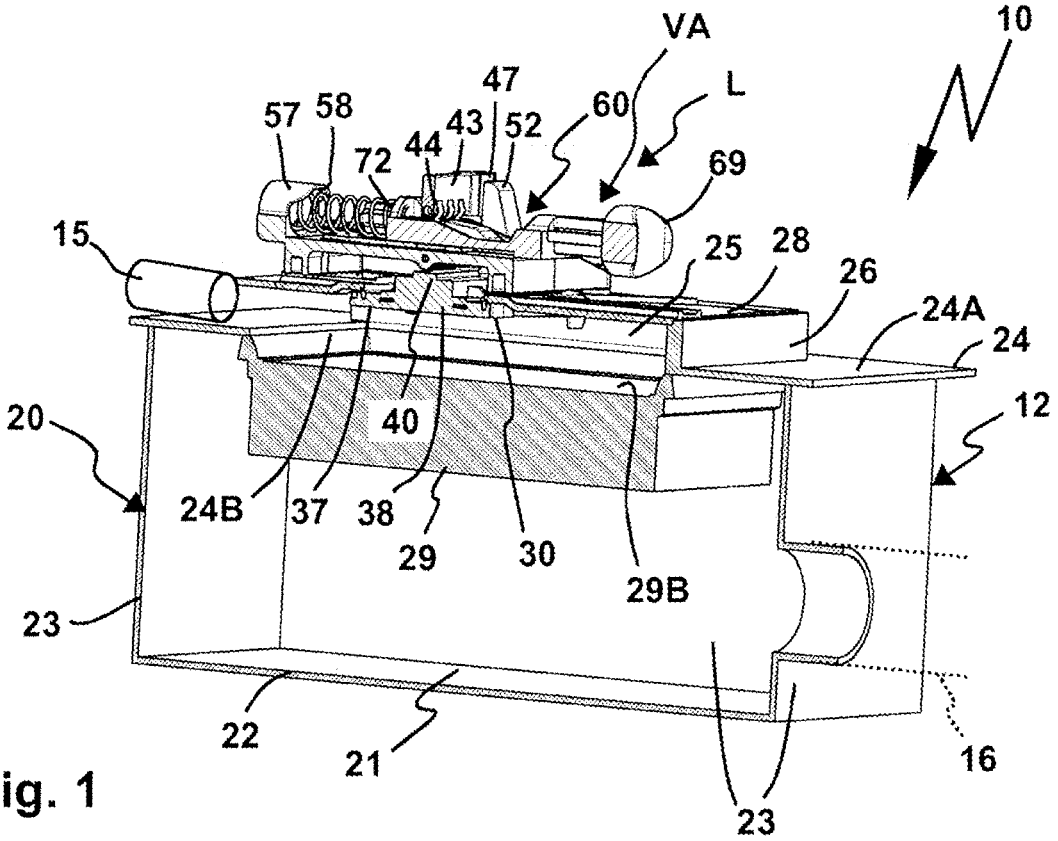
FIG. 1 is a perspective oblique longitudinal section of a first suction device in normal suction mode.

A suction device 10 is, for example, designed as a domestic vacuum cleaner or a workshop vacuum cleaner. A stationary design of the suction device 10 for a central extraction system is possible in principle, however. In terms of its suction device housing and its basic functionality, a suction device 110 according to FIGS. 9 to 11 corresponds to the suction device 10, so that identical references are used for identical components of the suction devices 10, 110. These are explained below in the context of the suction device 10. The suction device 110 is partially provided with components identical to those of the suction device 10, differences of which are identified by reference numbers increased by 100.

In the drawing, the suction device 10 is partially illustrated in a highly diagrammatic manner. At its suction device housing 12, it may have rollers 11, for example, for rolling or placing on a ground.

The suction device housing 12, for example, has a lower part 20 and a cover 24. The lower part 20 can be provided with the rollers 11. A suction inlet 18 is provided on the lower part 20 for the inflow of a suction flow T, i.e. an air flow loaded with dirt, dust or the like, into a dirt collecting chamber 21.

At the suction inlet 18, there is, for example, provided a connecting piece 19 for connecting, in particular for plugging on, a hose 16. At its other end, the hose may be connected or can, for example, be connected to a suction nozzle of a hand-held power tool or the like.

The dirt collecting chamber 21, into which the suction inlet 18 leads, is provided in the suction device housing 12. Between the suction inlet 18 and a suction unit 15 of the suction device 10 for generating a suction flow T, a filter 29 is located for filtering out particles P contained in the suction flow T, so that they are retained in the dirt collecting chamber 21. At a base wall 22 of the suction device housing 12, in particular of the lower part 12, there forms an accumulation of dust or dirt S, for example. The particles P usually fall downwards, i.e. towards the base wall 22, but at least a part adheres to a lateral surface 29A facing the dirt collecting chamber 21, for example to an underside, of the filter 29. In the suction mode of the suction device 10, the filter 29 is therefore gradually contaminated or afflicted by particles P.

On the discharge side, however, the suction flow T is cleaned by the filter 29, so that it forms a clean suction flow T2 in a manner of speaking when flowing via a lateral surface 29B of the filter 29 towards an air outlet 17. The suction unit 15 is connected to the air outlet 17. The air outlet 17 is provided at an extraction channel arrangement 25 located downstream of the filter 29 in terms of the suction flow T.

The suction unit 15, for example, comprises a common suction turbine and an associated drive motor, which is not explained in detail. A suction turbine and a drive motor are obviously suitable for any suction device according to the invention, not only for the suction device 10.

The dirt collecting chamber 21 is bounded by the base wall 22 and by side walls 23. A front side wall 23 is not shown in the sectional views of the drawing. The lower part 20 is covered by a cover 24, which is expediently releasable from the lower part 20, so that dirt collected in the dirt collecting chamber 21 can be removed easily. It would be possible to provide a receptacle, e.g. a filter bag, in the dirt collecting chamber 21. In the cleaning mode, however, such a filter bag is unnecessary, because the filter 29 is cleaned effectively.

The extraction channel arrangement 25 is provided on the suction device housing 12, in particular on the cover 24.

At a cover wall 24A of the cover 24, a holder 27 is provided for the filter 29, for example. The filter 29 is, for example, installed into an opening 24B of the cover wall 24A and closes it, so that the dirt S is held back in the dust or dirt collecting chamber 21. A holder 27 for the filter 29 is preferably provided at the opening 24B.

Next to the filter 29 or at its outer circumference, a side wall or circumferential wall 26 is provided, and above the filter 29 a cover wall 28 of the extraction channel arrangement 25. The circumferential wall 26 and the cover wall 28 may, for example, bound a chamber and/or an extraction channel of the extraction channel arrangement 25, which leads to the air outlet 17.

At the extraction channel arrangement 25 there is provided an external air inlet 30 for scavenging air or external air F, which can flow through the filter 29 against the direction of the suction flow T to push particles P adhering to the filter 29 towards the dirt collecting chamber 21.

Each of the suction devices 10, 110 therefore has an external air inlet 30, through which external air F can flow to clean the filter 29. For closing and opening a respective external air inlet 30, external air valves 35, 135 described below and actuated in different ways are provided.

Figure 9:
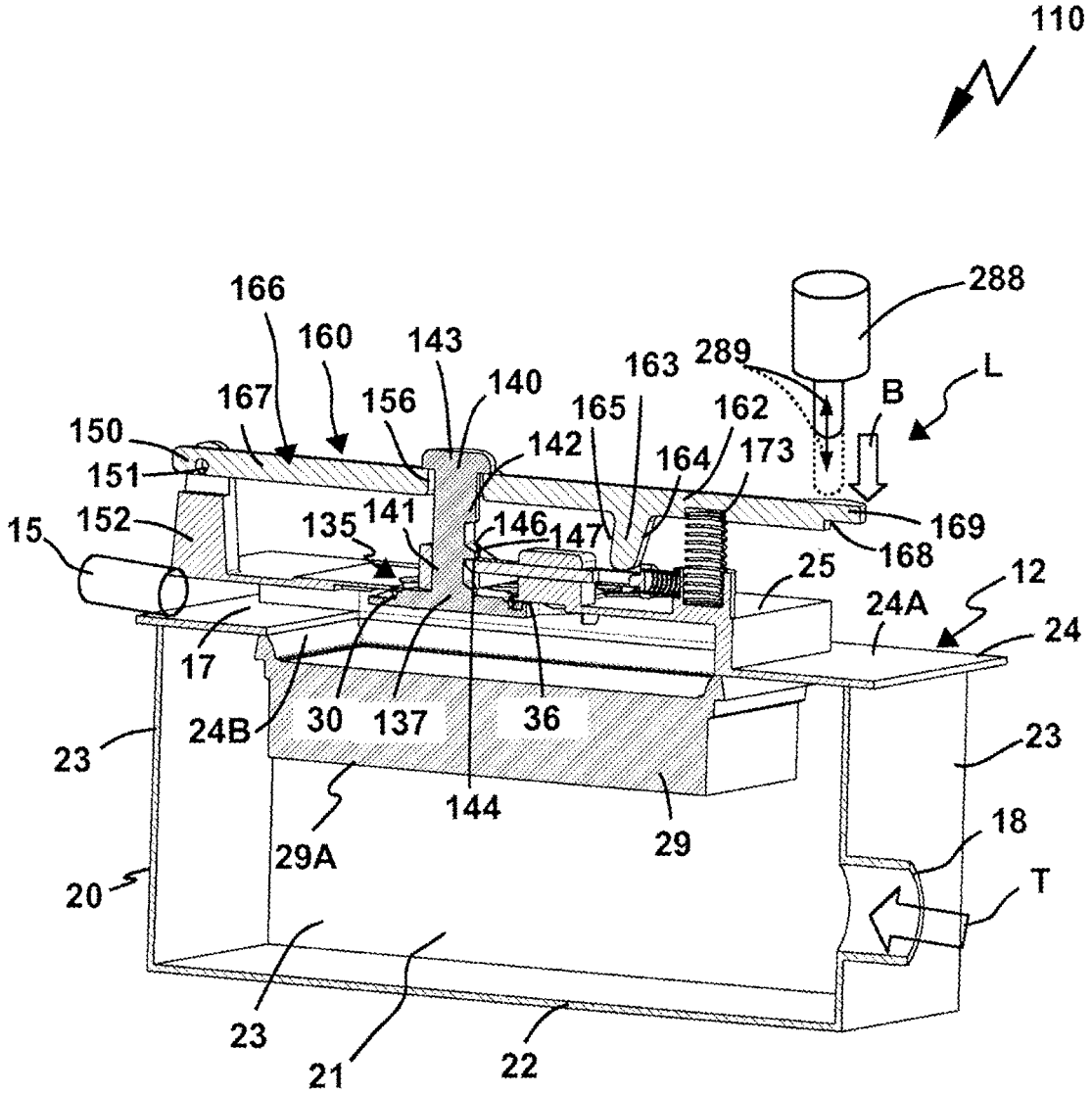
FIG. 9 is a perspective oblique longitudinal section of a second suction device in normal suction mode.

The external air inlet 30 can be closed by the external air valves 35, 135, wherein these adopt their closed position and the suction flow T flows from the suction inlet 18 through the dirt collecting chamber 21 and the filter 29 towards the air outlet 17 in the normal suction mode of the suction device 10 as shown in FIGS. 1 and 9.

For a cleaning mode, however, the external air inlet 30 is opened by the external air valve 35, 135 adopting its passage position O, i.e. the external air F can enter through the external air inlet 30 and is drawn in, in a manner of speaking, by the vacuum volume or the negative pressure in the dirt collecting chamber 21, whereby the filter 29 is freed of particles P.

The external air valve 35, 135 comprises an external air valve body 37, 137 designed in the manner of or having a valve disc 38, 138. The at least partially disc-shaped external air valve body 37, 137 bears in its closed position L against a valve seat 36 extending around the external air inlet 30. When the external air valve body 37, 137 bears against the valve seat 36, the external air inlet 30 is closed.

At the disc 38, 138 or at the valve seat 36, or at both components, there is expediently provided a seal 39 for tightly closing the external air inlet 30.

The seal 39 advantageously has an additional damping function when the disc 38 or the external air valve body 37, 137 is moved in the direction of the external air inlet 30 into the closed position L and arrives there.

A driving segment 40 for actuation by an actuation assembly 60 projects from the external air valve body 37. The driving segment 40 comprises connecting arms 41, which project from the external air valve body 37 and are connected to a support segment or power transmission segment 42 designed as a bridge 43 or comprising a bridge 43, for example. Projections 46 of the connecting arms 41 are, for example, inserted into receptacles 45 of the bridge 43. The bridge 43 extends between the connecting arms 41.

The bridge 43 is used to move the external air valve body 37 into the closed position L blocking the external air inlet 30 or into the passage position O opening up the external air inlet 30. For this purpose, the driving segment 40 is displaceable by means of a sliding bearing 50 relative to a valve base 31 having the external air inlet 30 or relative to the valve seat 36. The valve base 31 is, for example, provided by the cover wall 28 or located at the cover wall 28.

The bridge 43 can also be designated as a support body, driving body or supporting bridge.

The sliding bearing 50 comprises guide bodies 51. The guide bodies 51 project from the valve base 31, for example in the manner of supports 52 or pillars 52. Between each pair of guide bodies 51, the guide segments 47 of the driving segment 40 are guided in a linear fashion. The guide segments 47 are provided on the bridge 43, for example.

The actuation assembly 60 comprises an actuating element 61, e.g. a slide 62, which is movable relative to the valve base 31 along an actuation axis V. The actuating element 61 is mounted for linear movement on a guide body 53 extending beyond the external air inlet 30 and located on the valve base 31.

The guide body 53 is, for example, supported on the valve base 31 by support arms 54, 55. The support arms 54, 55 project laterally from the guide body 53, which has an oblong shape, in the manner of spiders or expanding feet, for example. In the end regions of the support arms 54, 55, there are provided connecting elements 59, in particular bolts or the like for example, for connecting the guide body 53 to the valve base 31 and/or the cover wall 28.

The guide body 53 has a guide receptacle or guide contour 56, which extends along the actuation axis V and in which the slide 62 or the actuating element 61 is movably accommodated. The actuating element 61 can therefore not move transversely to the actuation axis V, only along the actuation axis V.

The actuating element 61 has a guide contour 63, which is designed as a protruding rib or step, for example, and which engages the guide contour 56 or guide receptacle 56 from behind.

Figure 2:
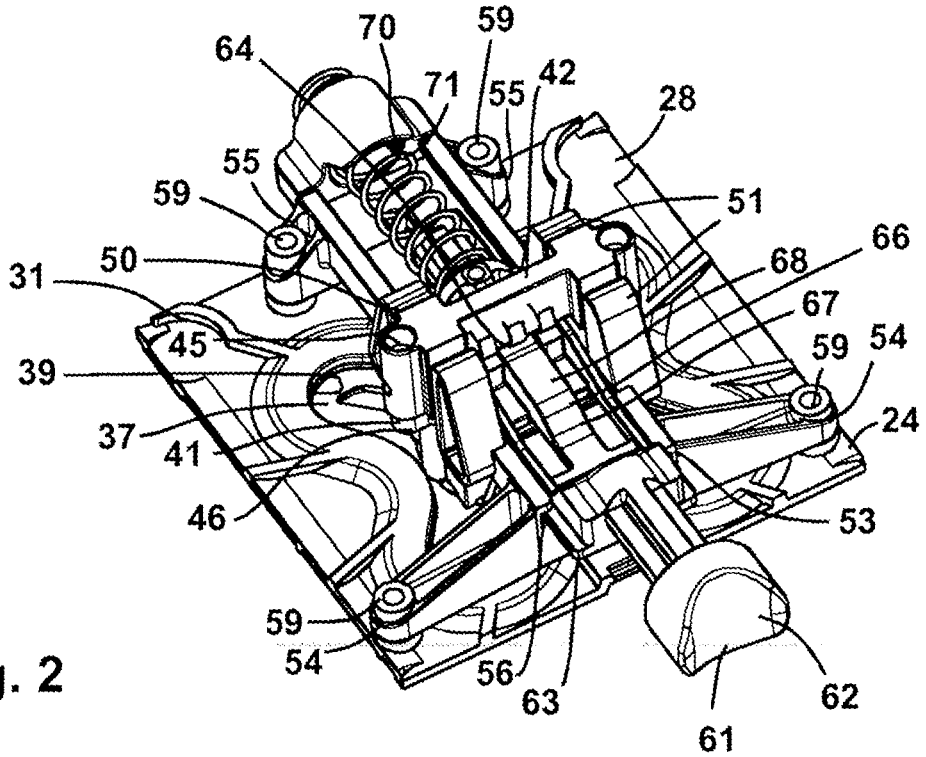
FIG. 2 is a perspective view from above of an external air valve of the suction device according to FIG. 1.
Figure 3:
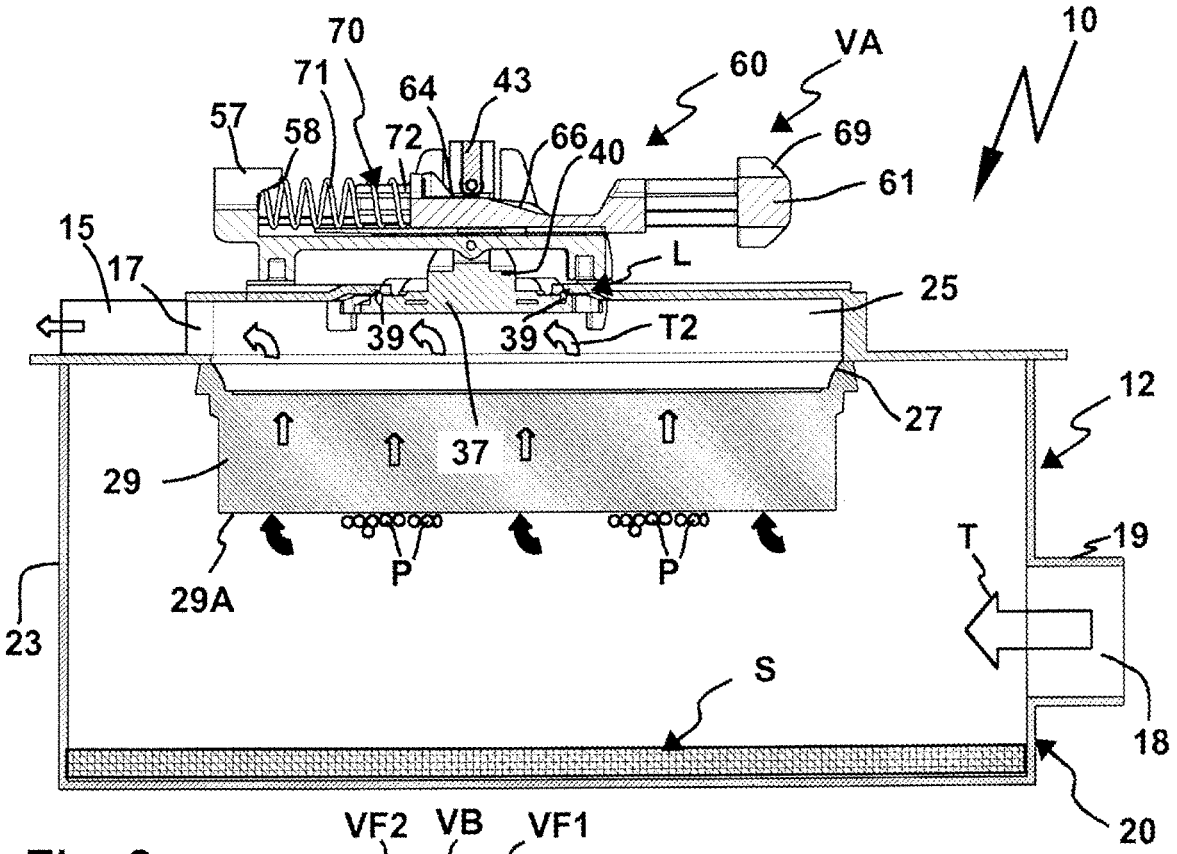
FIG. 3 is the view according to FIG. 1, but directly from the side.
Figure 4:
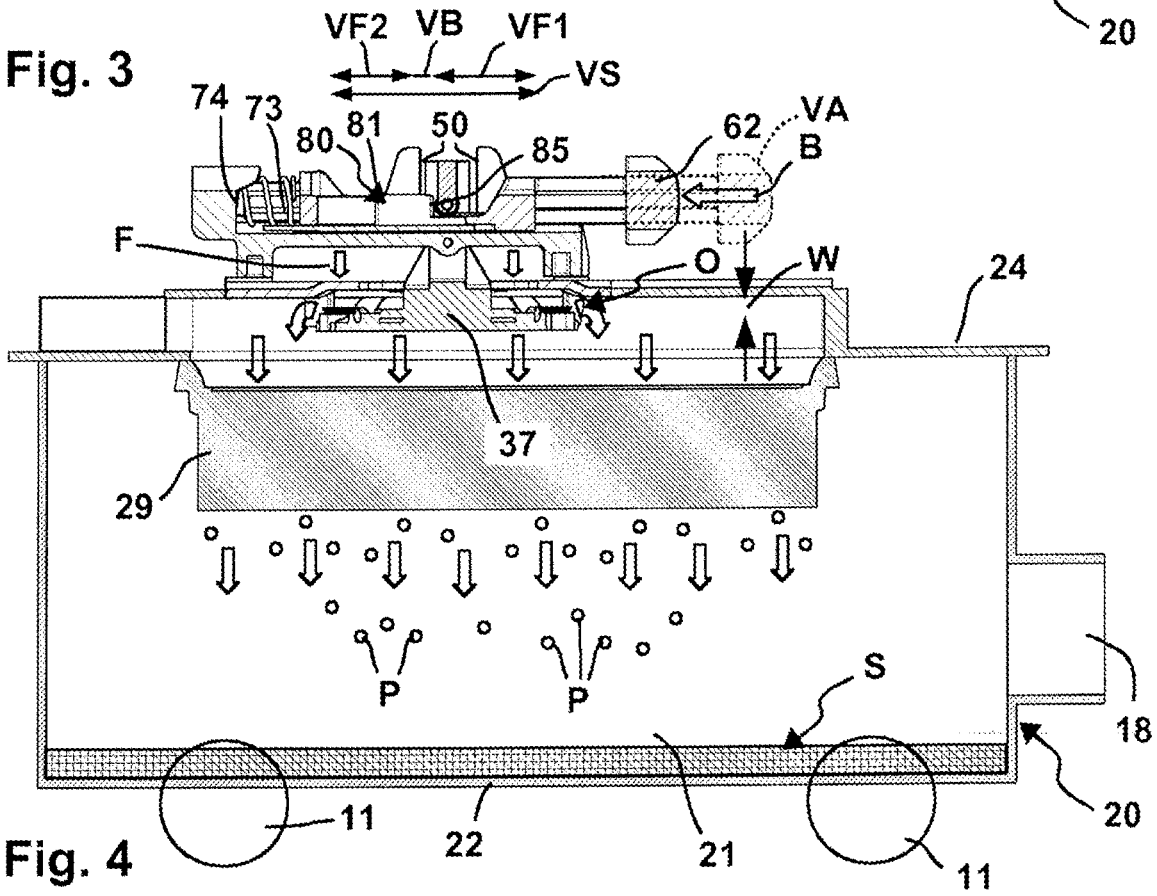
FIG. 4 is the view according to FIG. 3, but in a cleaning mode.
Figure 5:
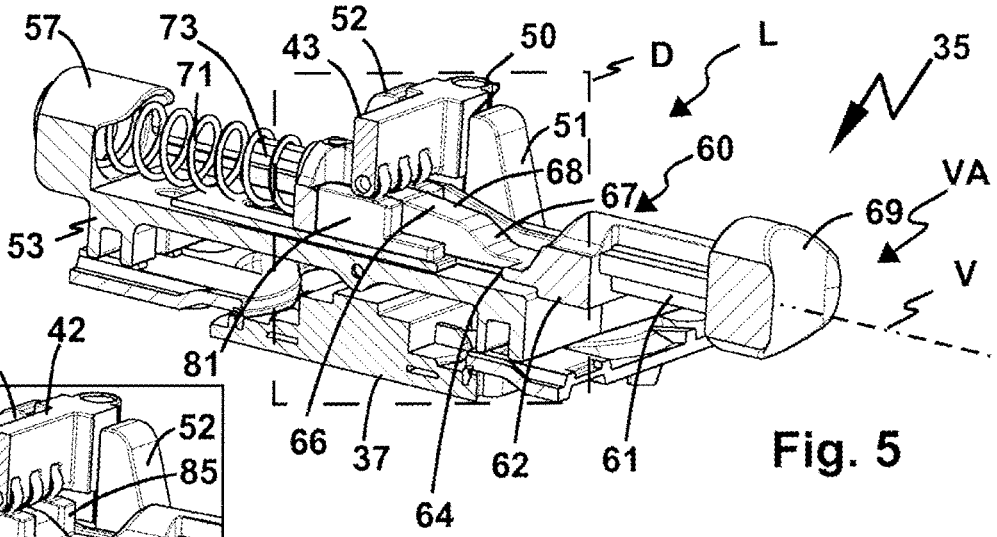
FIG. 5 is a perspective oblique view of the external air valve according to the preceding figures in the closed position in normal suction mode.
Figure 6:
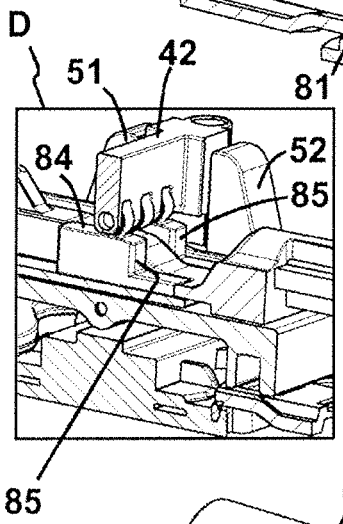
FIG. 6 shows a detail from FIG. 5.

The actuating element 61 is loaded towards its starting position VA shown in FIGS. 1 to 3 by a spring assembly 71, comprising a coil spring for example. The spring assembly 71 is supported on an abutment 57 of the valve base 31. A coil spring of the spring assembly 71 is accommodated in a receptacle 58 of the abutment 57, for example.

The coil spring or spring assembly 71 is supported on the slide 62 or the actuating element 61, for example on an abutment 72. A guide segment 73 for guiding the spring assembly or coil spring 71 projects in front of the abutment 72. The guide segment 73 engages with an interior of the coil spring 71 in the manner of a guide projection, for example. At the same time, a free end section 74 of the guide segment 73 is provided as a stop against the abutment 57, so that the actuating element 61 can move along an actuating path VS between the starting position VA and the end position VE limited by the abutment 57.

The spring assembly 71 forms an energy storage device 70, which is charged while the actuating element 61 is moved from the starting position VA to the end position VE, in order to move the external air valve 35 back from the passage position O into the closed position L. For this purpose, bevels 67, 68, which together from actuating contours of a bevel mechanism 66, are provided on the actuating element 61. A bridge 43 can slide along the bevels 67, 68, and sliding surfaces can be provided for this purpose, for example. In the present case, this movement is indeed facilitated by the fact that rolls 44 capable of rolling along the bevels 67, 68 are provided at the bridge 43. If the slide 62 or the actuating element 61 moves from the end position VE into the starting position VA, the bridge 43 and thus the transmission segment 42 of the external air valve body 37 is accelerated towards the closed position L at a relatively high speed, wherein the external air valve body 37 is moved towards the valve seat 36 while being damped by the seal 39. A gradient of the bevel 68 is slightly flatter than that of the bevel 67, so that the bevel mechanism 66 can apply a stronger force in the direction of the closed position L, i.e. that the external air valve body 37 is moved towards the valve seat 36 with a force which is greater than a force achievable by the bevel 67. In this way, the external air valve 35 is reliably moved into the closed position L by the actuating element 61 in combination with the bevel mechanism 66.

The actuating path of the actuating element 61, however, is considerably longer than a closing path W of the external air valve body 37 between the passage position O and the closed position L, even in the region of the bevel mechanism 66.

In order to make external air valve body 37 capable of moving as instantaneously as possible from the closed position L into the passage position O while facilitating an adequate charge of the energy storage device, the following measures are taken.

Starting from the starting position VA, the actuating element 61 already starts to apply pressure to the coil spring of the spring assembly 71 on a free travel segment VF1 of the actuating path VS if an actuating force B acts on a manually actuable actuating region 69, which is designed as an actuating arm for example.

In the actuating region 69, there may, for example, be provided a gripping piece 69A, which an operator can press comfortably, e.g. with a finger.

On the free travel segment VF1, the external air valve body 37 remains non-actuated, however, i.e. in the closed position L. The driving segment 40, e.g. the bridge 43, remains supported on an actuating part 81 of a transmission 80 holding the external air valve body 37 in the closed position L during the movement of the actuating element 61 along the free travel segment VF1. Two of the rolls 44 are supported on a holding surface 84 of the actuating part 81, for example.

The actuating part 81 comprises a sliding body or slide, for example. The actuating part 81 is mounted at a guide 82 for movement in the direction of the actuation axis V.

The actuating part 81 has a clearance 83, for example, through which the actuating element 61 passes. In the clearance 83, the bevel 67, 68 are located, the bevels 67, 68 being movable relative to the holding surface 84. In this way, the driving segment 60 is optimally supported laterally adjacent to the bevels 67, 68 at mutually spaced points, i.e. the two holding surfaces 84.

The actuating element 61 is movable relative to the actuating part 81 along the actuation axis V, so that the actuating element 61 is movable relative to the valve base 31 along the actuation axis V independently of the actuating part 81 in the free travel segment VF1.

The external air valve body 37 is loaded in the direction of the passage position O by the negative pressure U prevailing in the dirt collecting chamber 21, only remaining in the closed position L because the driving segment 40 is supported on the actuating part 81, or more precisely on its holding surface 84. The negative pressure U is in any case lower than an atmospheric pressure A acting on that side of the external air valve body 37, 137 which is remote from the dirt collection chamber 21.

If the actuating element 61 is moved further towards the end position VE at the end of the free travel segment VF1, is passes through an actuating segment VB, where a driving stop 64 hits the actuating part 81, taking it along towards the end position VE. In this process, the holding surface 84 is pulled away under the rolls 44 in a manner of speaking, wherein the rolls 44 roll along a sloping surface 86 and an adjoining step 85 and instantaneously arrive at a stop face 87, in a downward direction in the drawing, for example. As a result, the external air valve body 37 instantaneously opens up the external air inlet 30, through which external air F or scavenging air then flows on the direction of the filter 29.

The stop face 87 limits the movement of the external air valve body 37 in the direction of the passage position O. A height of the step 85, which could also be described as a release contour, corresponds to the closing path W.

Beyond the actuating segment VB, the actuating element 61 can expediently be moved further in the direction of the end position VE in order to further charge the energy storage device 70. This further tensions the spring assembly 71.

The actuating part 81—a slide in a manner of speaking—can be carried along further in the direction of the end position VE in this process and passes through a further free travel segment VF2. During the movement of the actuating element 61 along the free travel segment VF2, the external air valve body 37 remains in the passage position O or at the end of the closing path W, remaining non-actuated. The stop face 87 accordingly extends along the free travel segment VF2.

If the operator releases the actuating element 61, the energy storage device 70 can actuate the actuating element 61 from the passage position O into the closed position L, acting as a return device for the external air valve body 37. In this process, the actuating element 61 already gains momentum on the free travel segment VF2 before the bevel mechanism 66 actively actuates the external air valve body 37 in the direction of the closed position L. At the end of this process, i.e. when the external air valve body 37 bears against the valve seat 36 and the driving segment 40 has been raised so far that the holding surface 84 can be moved under the bridge 43 or the actuating segment 42, a return stop 65 of the actuating element 61 comes into engagement with the actuating part 81, i.e. the slide, taking it along in the direction of the starting position VA, as a result of which the holding surface 83 moves under the bridge 43 or its rolls 44, thereby locating the external air valve body 37 in the closed position L. If applicable, the bevel 86 can be moved past the rolls 44 in this process in order to actuate the external air valve body 37 in the direction of the closed position L with an appropriate actuating force and/or to facilitate a movement of the holding surface 83 under the bridge 43.

It can be seen that in the embodiment shown in FIGS. 1 to 8 an actuating force could act tangentially to the suction device housing 12, so that an operator would have to support the latter, for example against rolling away. It is, however, simply possible to provide a diverting mechanism between the actuating element 61 and the external air valve 35, for example, so that the operator could apply an actuating force towards a ground on which the suction device 10 is placed.

Figure 7:
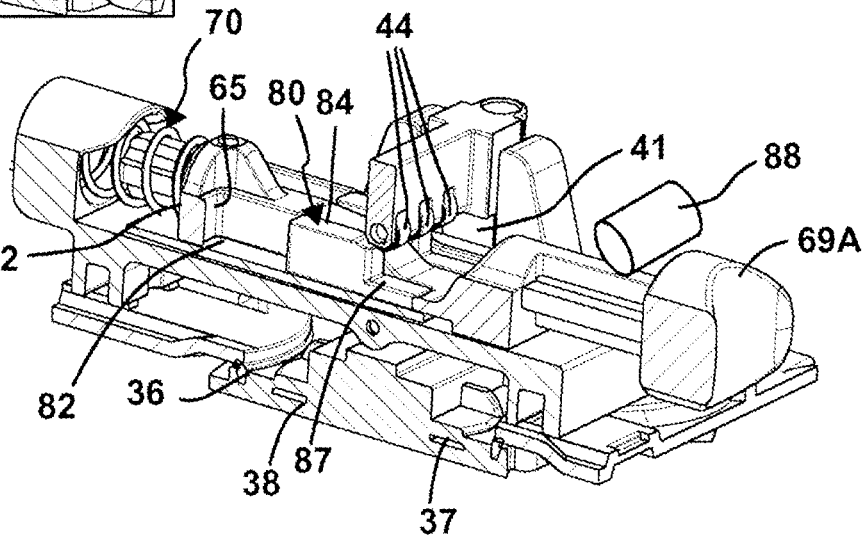
Figure 8:
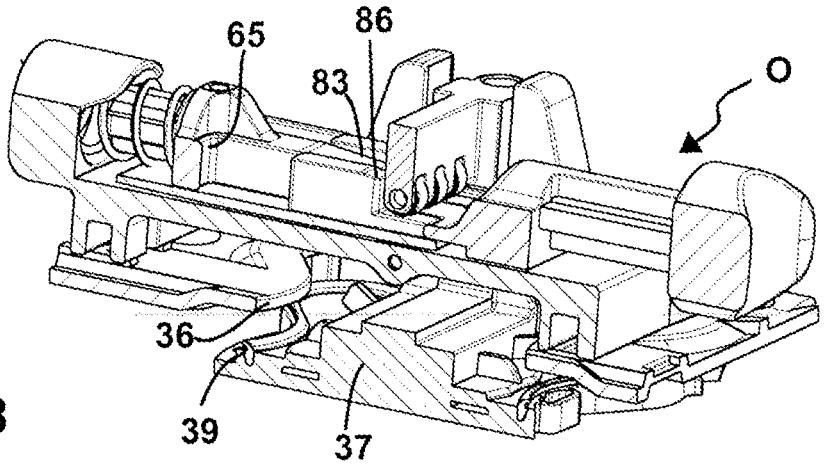
FIG. 8.

As an alternative or in addition, a servomotor 88 could be provided for moving the actuating element 61 along the actuating path VS (shown diagrammatically in FIG. 7). The servomotor 88 could, for example, have a pinion meshing with a rack section at the actuating element 61. The servomotor 88 could, for example, be motion-coupled to the actuating element 61 in the direction of the end position VE, but have free travel in the direction of the starting position VA.

Figure 10:
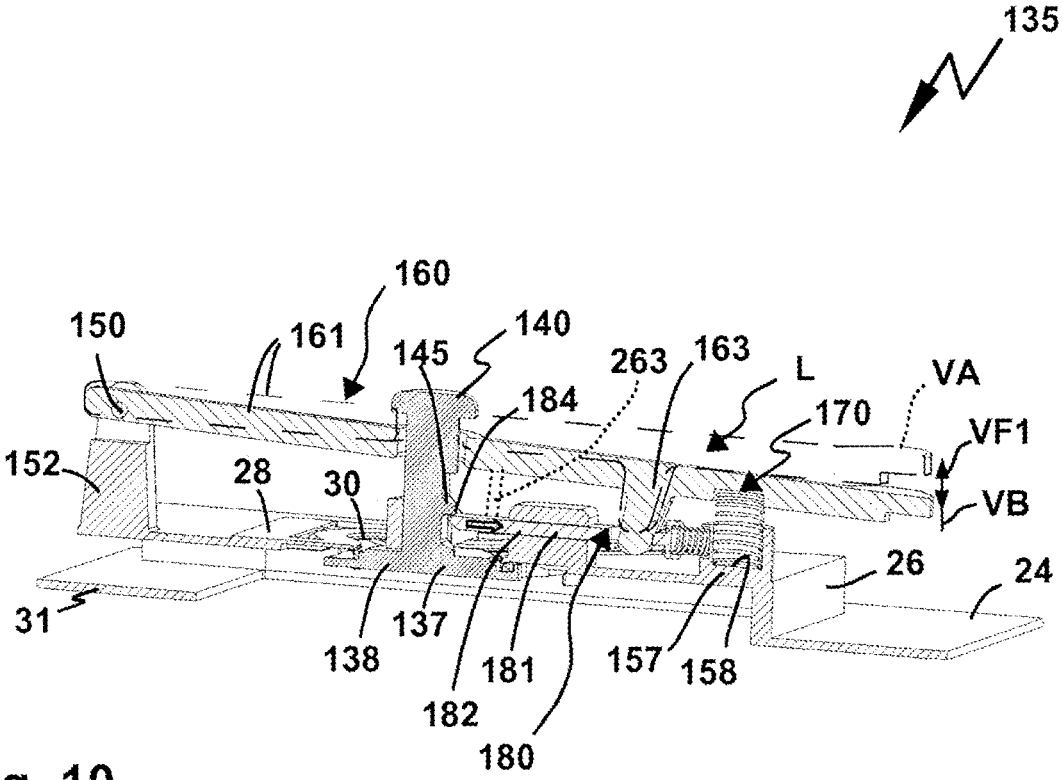
FIG. 10 is a perspective view of an external air valve, shown at an angle from above, of the suction device according to FIG. 9 in the closed position.
Figure 11:
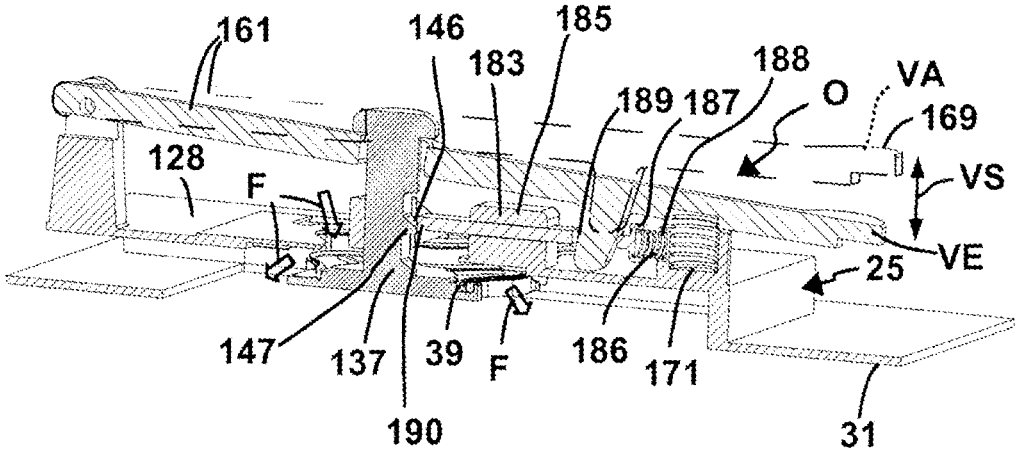
FIG. 11 shows the external air valve according to FIG. 10, but in a passage position.

In the embodiment shown in FIGS. 9 to 11, an actuating force B is advantageously oriented towards a ground or a base side of the suction device housing 12, so that in this case, too, an appropriate actuating force B can be applied to an actuating element 161 by means of a suitable actuator or servomotor 288, but manual operation by an operator is easy as well.

The servomotor 288, for example, has an actuator 289 capable of linear movement for applying the actuating force B. The servomotor 288 may be a pneumatic drive, an electric linear drive or the like, for example.

The external air valve body 137 of the external air valve 135 has a driving segment 140, which can be actuated in the region of a transmission segment 142 by an actuation assembly 160. The external air valve body 137 is likewise loaded towards the passage position O by the negative pressure U, is however held in the closed position L by the actuation assembly 160.

From the external air valve body 137, an actuating projection 141 passing through a driving receptacle 156 of the actuating element 161 projects in the manner of a peg, for example. The actuating element 161 comprises an actuating lever 162, which is pivotably mounted on a pivot bearing 150.

The pivot bearing 150 comprises a bearing block 152, for example, which projects from the valve base 31. A bearing bolt engaging with a bearing receptacle 151 in an end region of an arm segment 167 of the actuating lever 162 is held on the bearing block 152, for example.

With the actuating lever 162, which forms a part of a lever mechanism 166, the external air valve body 137 can be actuated from the passage position O into the closed position L.

The driving receptacle 156 is located between the arm segment 167 and a further arm segment 168, in the end region of which an actuating region 169 for gripping or operation by an operator is provided.

If the actuating lever 162 moves away from the external air inlet 30, a head 143 is supported in the free end region of the actuating projection 141 on that side of the actuating lever 162 which is remote from the external air valve body 137, so that the actuating lever 162 carries the external air valve body 137 along into the closed position L. The lever arm of at least the arm segment 167 forms a lever mechanism 166, which actuates the external air valve body 137 in the direction of the closed position L for the purpose of a power boost.

The actuating element 161 is loaded by an energy storage device 170 towards a starting position VA assigned to the closed position L. The energy storage device 170 comprises a spring assembly 171, e.g. a coil spring. The spring assembly 171 is supported on an abutment 157 relative to the valve base 31 with the external air inlet 30 on the one hand and on the arm segment 168 on the other hand. There, a receptacle 173 for the spring of the spring assembly 171 is provided, for example. On the side of the valve base 31, there is provided a receptacle 158 for the spring of the spring assembly 171, for example. As a result, the energy storage device 170 or the spring assembly 171 acts on the actuating lever 162 in the end region thereof which is remote from the pivot bearing 150, with the effect of a power boost. This contributes to the fact that a relatively great force, in any case a boost for an actuating force of the energy storage device 170, is applied to the external air valve body 37 in the direction of the closed position L.

The actuating region 169 pivots about the pivot axis of the pivot bearing 150. The energy storage device 170 or the spring assembly 171 respectively can be charged or tensioned respectively along almost the whole of the pivoting path of the actuating region 169, which represents an actuating path VS. In this process, the actuating element 161 passes, starting from the starting position VA, first a free travel segment VF1, in which the spring assembly 171 is tensioned but the external air valve body 37 remains in the closed position L, i.e. is not released. This movement can be seen if FIGS. 9 and 10 are viewed together, for example. In this process, the driving receptacle 156 moves along the driving segment 140, so that the head or peg 143 is released from the actuating lever 161, i.e. projects in front thereof (see FIG. 10). The spring assembly 171 is already being tensioned.

On a further actuating segment VB of the actuating path VS, which adjoins the free travel segment VF1, an actuating projection 163 comes into engagement with an actuating part 181 of a transmission 180. The actuating part 181 comprises a slide, for example, which is mounted on a guide 182 for movement relative to the valve base 31. The slide or actuating part 181 has a holding projection or holding segment 184, which in the position according to FIGS. 9 and 10 is in engagement or in engagement from behind with a holding surface 144 provided on the driving segment 140. As long as the holding segment 184 or the actuating part 181 is in engagement with the holding surface 144, the external air valve body 37 cannot enter the passage position O. The holding surface 144 is, for example, provided on a holding projection 147 projecting from the driving segment 140 or the actuating projection 141.

The actuating part 181 is rod-shaped. It is, for example, accommodated in a guide receptacle 183 of a bearing element 185 and capable of movement along the actuation axis V, so that it can be disengaged from the holding surface 144.

The actuating part 181 is, for example, loaded by a spring assembly 186, e.g. a coil spring, into the holding position holding the driving segment 140 and thus holding the external air valve body 37 in the closed position L, i.e. towards engagement with the holding surface 144. The spring assembly 186 is supported on an abutment face 187 at one end, for example. The abutment face 187 is, for example, provided in an end region opposite to that with the holding segment 184. At the other end, the spring assembly 186 is, for example, supported on a support surface 188 of the valve base 31, e.g. at the outer circumference of a cylindrical surface provided with the receptacle 158.

To actuate the actuating part 181 into a release position, i.e. to disengage it from the holding surface 144, an actuating projection 163 is provided on the actuating element 161. The actuating projection 163 engages with a driving receptacle 189 of the actuating part 181. If the actuating element 161 is actuated from the starting position VA in the direction of the end position VE, a driving contour 164 acts against a stop region or longitudinal end region of the driving receptacle 189 to move the actuating part 181 away from the holding surface 144 or the driving segment 140, thereby releasing the external air valve body 137, so that it moves towards the passage position O under the action of the negative pressure U. This happens instantaneously, because in principle the external air valve body 137 is unlatched from the closed position L in a manner of speaking.

The external air valve body 137 hits the actuating element 161 with the head 143 in the passage position O.

For moving from the passage position O to the closed position L, the energy storage device 170 acts once again as described above. To enable the actuating part 181 to pass the holding projection 147, an actuating chamfer 146 having an inclination for moving the actuating part 181 into the release position is provided thereon. The actuating part 181 preferably slides along the actuating chamfer 146 with a chamfer 190. This provides for a bevel mechanism or a wedge gear mechanism for actuating the actuating part 181 when moving the external air valve body 137 or the driving segment 140 in the direction of the closed position L. It is, however, also possible to provide that a return contour 165, for example, hits the actuating projection 163 on the driving receptacle 189, thereby actuating the actuating part 181 in the direction of the release position if the actuating element 161 pivots in the direction of the starting position VA.

It is obvious that between the end position VE and the actuating segment VB a further free travel segment not shown in detail in the drawing can be provided in order to charge the energy storage device 170 further or to tension the spring assembly 171 more tightly, so that the force for returning the external air valve body 137 into the closed position L is correspondingly greater.

The possibility of the active actuation of the external air valve body 137 in the direction of the passage position O, for example by means of an actuating projection 263 on the actuating element 161, is indicated diagrammatically only. This variant can, for example, support the actuation of the external air valve body 137 by negative pressure U or, in embodiments where of the external air valve body is held in the closed position by negative pressure, open the external air valve body by applying a suitable actuating force to the external air valve body in the direction of the passage position O.

In place of the slidable actuating parts 81, 181, a pivotable component could be provided, for example a hook engaging the bridge 43 or the holding surface 144 from below and capable of being diverted into a disengagement position or release position by the actuating elements 61, 161 on the actuating segment VO.

The invention claimed is:

1. A suction device having a suction unit for generating a suction flow and having a suction device housing, in which a dirt collecting chamber is arranged, which has a suction inlet and is flow-connected to the suction unit via at least one filter and an extraction channel arrangement, wherein at least one external air inlet, which can be closed by an external air valve, is arranged on the extraction channel arrangement between the filter and the suction unit, wherein the external air valve has an external air valve body for closing the external air inlet, which external air valve body can be moved, by adjusting an actuating element along an actuation path, between a closed position closing the external air inlet and a passage position releasing the external air inlet, in which external air flowing through the external air inlet flows through the at least one filter in the direction of the dirt collecting chamber for cleaning purposes, and wherein a transmission is arranged between the actuating element and the external air valve body, which transmission enables a movement of the actuating element over at least one free travel segment of the actuating path without any effect on the external air valve body and, on an actuating segment of the actuating path of the actuating element, releases the external air valve body for movement from the closed position to the passage position and/or transmits an actuating force of the actuating element acting towards the passage position to the external air valve body.

2. The suction device according to claim 1, wherein the at least one free travel segment of the actuating path comprises or is represented by a free travel segment which extends between a starting position of the actuating element assigned to the closed position and the actuating segment and/or a free travel segment which extends between the actuating segment and an end position of the actuating element which is farthest away from a starting position assigned to the closed position.

3. The suction device according to claim 1, wherein the actuating element and/or the transmission form(s) or comprise(s) an actuating device for moving the external air valve body in the direction of its closed position.

4. The suction device according to claim 1, further comprising an energy storage device for moving the external air valve body into the passage position or the closed position, wherein the energy storage device serves to provide an actuating force actuating the external air valve body towards the passage position or the closed position.

5. The suction device according to claim 4, wherein the energy storage device can be charged at an actuation of the actuating element along the at least one free travel segment and/or wherein it is coupled to a respective actuating component comprising the actuating element and/or the transmission and/or the external air valve body, so that the energy storage device is charged at a movement of the actuating component.

6. The suction device according to claim 4, wherein the actuating element charges the energy storage device when moving along its actuating path, and/or wherein the actuating element is loaded by the energy storage device in the direction of a starting position of the actuating path which is assigned to the closed position of the external air valve body.

7. The suction device according to claim 4, wherein the energy storage device acts on the external air valve body via a power-boosting gear mechanism and/or a bevel mechanism and/or a lever gear mechanism.

8. The suction device according to claim 1, wherein the actuating element can be actuated manually and/or driven by a servomotor forming a part of the suction device.

9. The suction device according to claim 1, wherein the actuating element is located at a top side of the suction device housing remote from a ground during the use of the suction device, and/or wherein the actuating element comprises a manually actuable actuating segment, wherein the actuating segment, for moving the external air valve body in the direction of the passage position, passes through a path in the direction towards the suction device housing and/or in the direction towards a base side of the suction device housing, which is oriented towards a ground or assigned to the ground during a use of the suction device, and/or in that a direction of a force for the manual actuation of the actuating element is oriented approximately vertically during the use of the suction device.

10. The suction device according to claim 1, wherein the actuating element is mounted on the suction device housing slidably by means of a sliding bearing and/or pivotable by means of a pivot bearing.

11. The suction device according to claim 1, wherein the transmission is designed for an instantaneous release of the external air valve body in the direction of the passage position or an instantaneous transmission of the actuating force of the actuating element to the external air valve body in the direction of the passage position.

12. The suction device according to claim 1, wherein the at least one free travel segment or the sum of its parts is at least twice as long as the actuating segment, and/or wherein the actuating path of the actuating element is longer than a closing path of the external air valve body between its open position and its closed position.

13. The suction device according to claim 1, wherein the transmission has a pawl and/or step and/or bevel and/or actuating slide assigned to the actuating segment.

14. The suction device according to claim 1, wherein the transmission comprises a lever gear mechanism and/or a bevel mechanism.

15. The suction device according to claim 1, wherein the transmission is designed for boosting the power of an energy storage device loading the external air valve body in the direction of its closed position.

16. The suction device according to claim 1, wherein the transmission comprises an actuating part, which is designed as an actuating slide and remains stationary relative to the external air valve body on the at least one free travel segment, not being actuated by the actuating element, and which is taken along by the actuating element on the actuating segment for moving the external air valve body into the passage position.

17. The suction device according to claim 1, wherein the actuating element has a driving segment for moving the external air valve body in the direction of the closed position, and/or wherein a driving region of the external air valve body is slidably accommodated in a receptacle of the actuating element.

18. The suction device according to claim 1, wherein the external air valve body is loaded in the direction of its passage position by an application of negative pressure to the suction unit, and/or wherein a side of the external air valve body which faces the dirt collecting chamber is provided for moving the external air valve body in the direction of the passage position.

* * * * *